US006109087A

United States Patent [19]

Yoshii et al.

[11] Patent Number: 6,109,087

[45] Date of Patent: Aug. 29, 2000

[54] APPARATUS AND METHODS FOR TRANSFERRING WORKPIECE IN A TRANSFER PRESS MACHINE

[75] Inventors: Eiichi Yoshii, Yokohama; Takao Iura, Yokosuka; Yoshio Takahashi; Yoshio Mori, both of Yokohama; Takeo Hashizume, Tokyo, all of Japan

[73] Assignee: Ishikawajima-Harima Heavy Industries Co., Ltd., Tokyo, Japan

[21] Appl. No.: 09/300,259

[22] Filed: Apr. 27, 1999

[30] Foreign Application Priority Data

Apr. 27, 1998 [JP] Japan ..... 10-116367

[51] Int. Cl.[7] ..... B21D 43/05

[52] U.S. Cl. ..... 72/405.16; 72/405.1; 72/405.01; 198/621.1

[58] Field of Search ..... 72/405.01, 405.1, 72/405.11, 405.12, 405.16; 198/621.1–621.4

[56] References Cited

U.S. PATENT DOCUMENTS 3,876,084 4/1975 Munch ..... 198/218
4,361,413 11/1982 Toda ..... 72/405.1
4,728,253 3/1988 Oba ..... 72/421

FOREIGN PATENT DOCUMENTS 58-148031 9/1983 Japan ..... 72/405.01

*Primary Examiner*—Daniel C. Crane
*Attorney, Agent, or Firm*—Griffin & Szipl, P.C.

[57] ABSTRACT

Cross bars 18, to which workpiece holders 19 are attached, are provided across a press line L, together with feed beams 14 between which the cross bars are installed and which are suspended from the lift beams 13 and can move freely in the horizontal direction of the press line. A feed and transfer device 52 can move the feed beams freely in the horizontal direction of the press line. A connecting rod 56 connects the feed beams and the rack beam in a freely rotatable manner. A connecting link 60 connects a point in the vicinity of an intermediate portion of the connecting rod to a bracket 58 installed on the rack beam, in a freely rotatable manner. An operating direction changeover mechanism 61 converts the differential movement caused by the curvature of the press transfer motion, produced in the feed beams when the lift beams are raised or lowered, into a horizontal movement in the direction of the press line in synchronism with the raising or lowering of the lift beams.

6 Claims, 7 Drawing Sheets

APPARATUS AND METHODS FOR TRANSFERRING WORKPIECE IN A TRANSFER PRESS MACHINE

BACKGROUND OF THE INVENTION

1. Technical Field of the Background

The present invention relates to an apparatus and methods for transferring the workpiece in a transfer press machine, in which the operation of transferring the workpiece is carried out by a combination of a rack and pinion, etc.

2. Prior Art

A conventional transfer press machine known in the prior art uses a system with a cam mechanism in which the dies are driven up and down in synchronism with the transfer of the workpiece. Recently, however, a system using a combination of a servo motor and a rack and pinion drive, etc., has been proposed to replace the system with a cam mechanism for transferring the workpiece, because there has been a demand for higher operating speeds in transfer press machines.

FIG. 1 is a schematic view showing such an example of a conventional system. In the transfer press machine 1, a main press unit 2 is configured with a bed 3 arranged along a press line L, a specified number of uprights 4 located opposite each other along the press line on the bed 3, and a crown 5 installed on the upper surface of the uprights 4. In addition, slides 7, carriers 8, and bolsters 9 are installed and arranged between the uprights 4; an upper die 6 is mounted on the lower surface of each slide for pressing and processing the workpiece, such as a door for an automobile, and can freely be raised and lowered by means of an up and down device, not illustrated, housed in the crown 5, and a lower die 10 is installed opposite the upper die 6 on the top of each bolster 9, which is mounted on the carrier 8 on the bed 3.

In addition, a pair of lift beams 13 are provided and arranged opposite each other and parallel to the press line L alongside the dies, and can be driven up and down by servo motors 11 and rods 12. Furthermore, underneath each lift beam 13, a feed beam 14 is hung and arranged in a manner that it can move freely in the horizontal direction along the press line L, while the beam 14 can be raised and lowered integrally with the lift beam 13. The feed beams 14 are supported by a plurality of cam followers 15 that grip the upper and lower surfaces of rails 16 provided on both sides of the lift beams 13, and can travel along them. Also, cross bars 18 are installed laterally on the feed beams 14 at the same intervals as those in which the dies are arranged, in the direction orthogonal to the press line L, and workpiece holders 19 are mounted on the cross bars 18 and on which workpieces are hung in order to carry them in and out of the lower dies 10.

In addition, on the upstream side of the inlet of the main press unit 2 (left side in FIG. 1), feed and transfer equipment 25 is arranged and comprised of a servo motor 21 that drives the feed beams 14 which are free to move horizontally in the direction of the press line L, a pinion 22 driven and rotated by the servo motor 21, and a rack beam 24 on the upper surface of which there is a rack 23 engaging with the pinion 22. In addition, a connecting rod 27 with a predetermined length (radius) R is connected to a bracket 26 provided on the lower surface of the rack beam 24 and to a feed beam 14, via connecting pins 28 and 29, respectively, in a freely rotatable manner.

When a workpiece is to be conveyed to a downstream pressing process, the feed and transfer device 25 is stopped from moving in the direction of the transfer line L, and first the workpiece, not illustrated, that is on the lower die 10 is engaged by the workpiece holder 19 attached to the cross bar 18 mounted on the feed beams. Next, the feed beams 14 which are suspended so that they are free to move in the horizontal direction along the press line L, the lift beams 13 that are free to be raised and lowered by the servo motor 11, and the rods 12 are raised, and the workpiece is removed from the lower die 10. The workpiece, that has been raised, is next transferred along the feed beam 14 by the feed and transfer device 25 until it is over the next lower die 10 on the downstream side of the press line L. Next, the lift beam 13 is lowered, the workpiece holder 19 is disengaged from the workpiece, and the workpiece is placed on the lower die 10.

However, the feed beam 14, suspended from the lift beam 13 moves in an arc with the radius R of the connecting rod 27 about the point O of the connecting pin 28 in the bracket 26 of the rack beam 24, when the lift beam 13 is raised and lowered (ascending in FIG. 1), that is, when the beam is raised from the position M to the position N, over a vertical distance H. This movement in an arc causes a displacement X of the feed beam 14, when it is lifted, because of the differential movement in the direction of the press line L due to the curved path of the press transfer motion. Likewise, the curved path of the press transfer motion also causes a differential movement when the feed beam is lowered. Normally, the workpiece must be raised and lowered perpendicularly with respect to the lower die 10. Otherwise, the workpiece may be deflected vertically, tilted or be displaced, so the workpiece will not be pressed and processed in the preferred manner. Consequently, the position of the rack has to be adjusted during the lifting operation, through a complicated correcting operation, which has been a difficult problem in practice.

FIG. 2 is a schematic view showing another conventional example known in the prior art. Unlike FIG. 1 in which the rack beam and the feed beam are connected by the connecting rod that moves up and down in a freely rotatable manner, in FIG. 2, the feed beam is connected to a vertical rod mounted on the rack beam, through a connecting rod that can be freely raised and lowered. More explicitly, the feed and transfer device 38 is composed of a servo motor 21 that moves the feed beam 35 which is free to move horizontally in the direction of the press line L, a pinion 22 rotated and driven by the servo motor 21, and a rack beam 37 provided with a rack 36 that engages with the pinion 22, on the upper surface thereof. The vertical rod 39 is installed on the lower surface of the rack beam 37 close to the end of the rack beam on the side facing the feed beam 35. The connecting rod 41 is provided with a slide bearing 40 that allows the vertical rod 39 of the rack beam 37 to slide through the connecting rod 41 so that it is free to move up and down. In this system, there is no movement in the direction of transfer of the workpiece, when the feed beam moves up and down. However, when the connecting rod is long, a deflection Y is produced due to the effect of gravity on the rod which is supported as a cantilever. Therefore, the vertical rod 39 cannot slide smoothly through the slide bearing 40, so that a runout or tilt occurs during raising and lowering in the same manner as described above, and the workpiece cannot be transferred easily, and in practice, this is experienced as a difficult problem.

SUMMARY OF THE INVENTION

The present invention has been produced to solve the problems described above. That is, the present invention aims at providing an apparatus and methods for moving and transferring a workpiece in a transfer press machine, with which (1) unwanted movements caused by the curvature of the press transfer motion associated with the raising and lowering operations can be converted into a movement in the transfer direction of the press line, (2) the unwanted movements caused by the curvature of the press transfer motion can be eliminated, (3) a complicated adjustment for correcting for the curvature of the press transfer motion in the raised position is no longer required, and (4) a workpiece can be moved and transferred using a simple mechanism.

The present invention offers an apparatus for moving and transferring the workpieces in a transfer press machine, comprised of a pair of lift beams arranged opposite each other and parallel to a press line, in such a manner that they can be freely raised and lowered, cross bars that cross the press line and support workpiece holders on which the workpiece can be hung and which place the workpiece onto and remove the workpiece from the dies, a pair of feed beams to which the cross bars are attached, suspended from the lift beams and freely movable in the horizontal direction of the press machine, a feed and transfer device provided with a servo motor, a pinion and a rack beam for moving the feed beams in the direction of the press line, a connecting rod for connecting the feed beams and the rack beam, in a freely rotatable manner, a connecting link one end of which is mounted in the vicinity of the center portion of the connecting rod and the other end on the rack beam, and an operating direction changeover mechanism that when the lift beams are raised or lowered, converts the differential movement caused by the curvature of the press transfer motion, produced in the feed beams, into a movement in the direction of the press line of the feed beams in synchronism with the raising or lowering of the lift beams.

According to the configuration of the present invention, the apparatus for moving and transferring the workpieces in a transfer press machine is provided with a pair of lift beams arranged opposite each other and parallel to a press machine, in such a manner that they can be freely raised and lowered, workpiece holders on which the workpiece can be hung and which place the workpiece onto and remove the workpiece from the dies, cross bars that support the workpiece holders and cross the press line, a pair of feed beams to which the cross bars are attached, suspended from the lift beams and freely movable in the horizontal direction of the press line, and a feed and transfer device comprised of a servo motor, a pinion and a rack beam for moving the feed beams in the direction of the press line, therefore the workpiece can be conveyed to the dies arranged in series at predetermined intervals, by moving the feed beams that support the workpiece holders and are suspended from the lift beams which can be freely moved up and down, in the direction of the press line by means of the feed and transfer device. In addition, the apparatus is also provided with a connecting rod for connecting the feed beams and the rack beam, in a freely rotatable manner, a connecting link one end of which is mounted in the vicinity of the center portion of the connecting rod and the other end on the rack beam, and an operating direction changeover mechanism that when the lift beams are raised or lowered, converts the differential movement caused by the curvature of the press transfer motion, produced in the feed beams, into a movement in the direction of the press line of the feed beams in synchronism with the raising or lowering of the lift beams, consequently the differential movement caused by the feed beams moving along an arc, with the radius of the connecting rod, that is the curvature of the press transfer motion can be eliminated.

According to a preferred embodiment of the present invention, the aforementioned operating direction changeover mechanism is a horizontal guide device or a link device provided in the feed and transfer device. In this configuration, the movement caused by the curvature of the press transfer motion, produced in the feed beams when the lift beams move up or down, is converted to a horizontal movement or a movement in the direction of the press line L by the horizontal guide device or the link device provided in the feed and transfer device, that is, the operating direction changeover mechanism, in synchronism with the raising or lowering of the lift beams. Therefore, an unwanted differential movement caused by the curvature of the press transfer motion can be easily converted into a horizontal movement or can be eliminated.

The above-mentioned horizontal guide device is composed of a horizontal guide unit installed on the opposite side of the rack beam to the rack in the feed and transfer device, a horizontal rod provided in the aperture of the horizontal guide unit and extending in the direction of the press line, and a slider mounted on the opposite end of the connecting rod to the end which is connected to the feed beams and which is freely movable in the direction of the press line along the horizontal rod. In this configuration, an unwanted differential movement caused by the curvature of the press transfer motion, produced in the feed beams in association with the raising or lowering of the aforementioned lift beams, can easily be converted to a movement in the horizontal direction or eliminated by the simple mechanism using the slider that is guided to move freely in the direction of the press line L.

The aforementioned horizontal guide device is composed of a horizontal guide unit mounted on the rack beam of the feed and drive device on the opposite side to the rack, a long slot constructed in the horizontal guide unit, extending in the direction of the press line, and a rotating shaft unit mounted on the opposite end of the connecting rod to the end which is connected to the feed beams, and guided by the long slot in a manner such that it is free to move in the direction of the press line. According to this configuration which is a different embodiment from the above-mentioned embodiment, an unwanted differential movement caused by the curvature of the press transfer motion, produced in the feed beams when the lift beams move up or down, can be converted easily into a horizontal movement by means of the simple mechanism using the rotating shaft unit that is guided by and can move freely along the long slot constructed in the direction of the press line L, and the differential movement can be eliminated.

The aforementioned link device is composed of brackets mounted on the rack beam of the feed and transfer device on the side opposite to the rack, and a changeover link that connects the brackets to the opposite end of the connecting rod to the end which is connected to the feed beams, in such a manner that the changeover link can freely rotate in the direction of the press line. According to this configuration, an unwanted differential movement caused by the curvature of the press transfer motion, produced in the feed beams in association with the raising and lowering of the aforementioned lift beams, can be easily converted to a movement in the direction of the press line L using a simple mechanism comprised of the changeover link that can freely rotate in the direction of the press line, and the difference can be eliminated.

In addition, according to the present invention, a method of transferring and moving the workpiece is provided for a transfer press machine, in which dies are arranged in the press machine at predetermined intervals along a press line for continuously pressing and processing the workpiece, feed beams that can be freely moved in the direction of the press line by a feed and transfer device comprised of a servo motor, a pinion and a rack beam, lift beams that support the feed beams and can be freely raised and lowered, and an operating direction changeover mechanism that converts the differential movement caused by the curvature of the press transfer motion, produced when the lift beams are raised or lowered, into a movement in the direction of the press line; in which the curvature of the press transfer motion of the feed beams, produced when the lift beams move up or down, is synchronized with the raising or lowering of the lift beams, the operating direction changeover mechanism acts to convert the up or down motion into a movement in the direction of the press line, and therefore it is no longer necessary to correct for the curvature of the press transfer motion by operating the rack during lifting.

According to the aforementioned method of the present invention, an operating direction changeover mechanism is incorporated that converts the differential movement caused by the curvature of the press transfer motion, produced when the lift beams are raised or lowered, into a movement in the direction of the press line, and (1) an unwanted differential movement caused by the curvature of the press transfer motion produced in the feed beams as the lift beams are moved up or down, is synchronized with the raising or lowering of the lift beams, (2) the operating direction changeover mechanism is actuated, (3) the up or down movement is converted to a movement in the direction of the press line, (4) the unwanted differential movement caused by the curvature of the press transfer motion is eliminated, and (5) it is no longer necessary to correct the differential movement caused by the curvature of the press transfer motion, by means of rack movements during lifting. Consequently, an unwanted differential movement caused by the curvature of the press transfer motion, produced in the feed beams when the lift beams are moved up or down in a conventional system, is converted into a m movement in the direction of the press line L using the simple operating direction changeover mechanism, and can be easily eliminated.

The other objects and advantages of the present invention can be understood from the following description and by referring to the attached drawings.

DESCRIPTION OF PREFERRED EMBODIMENTS

Figure 1:
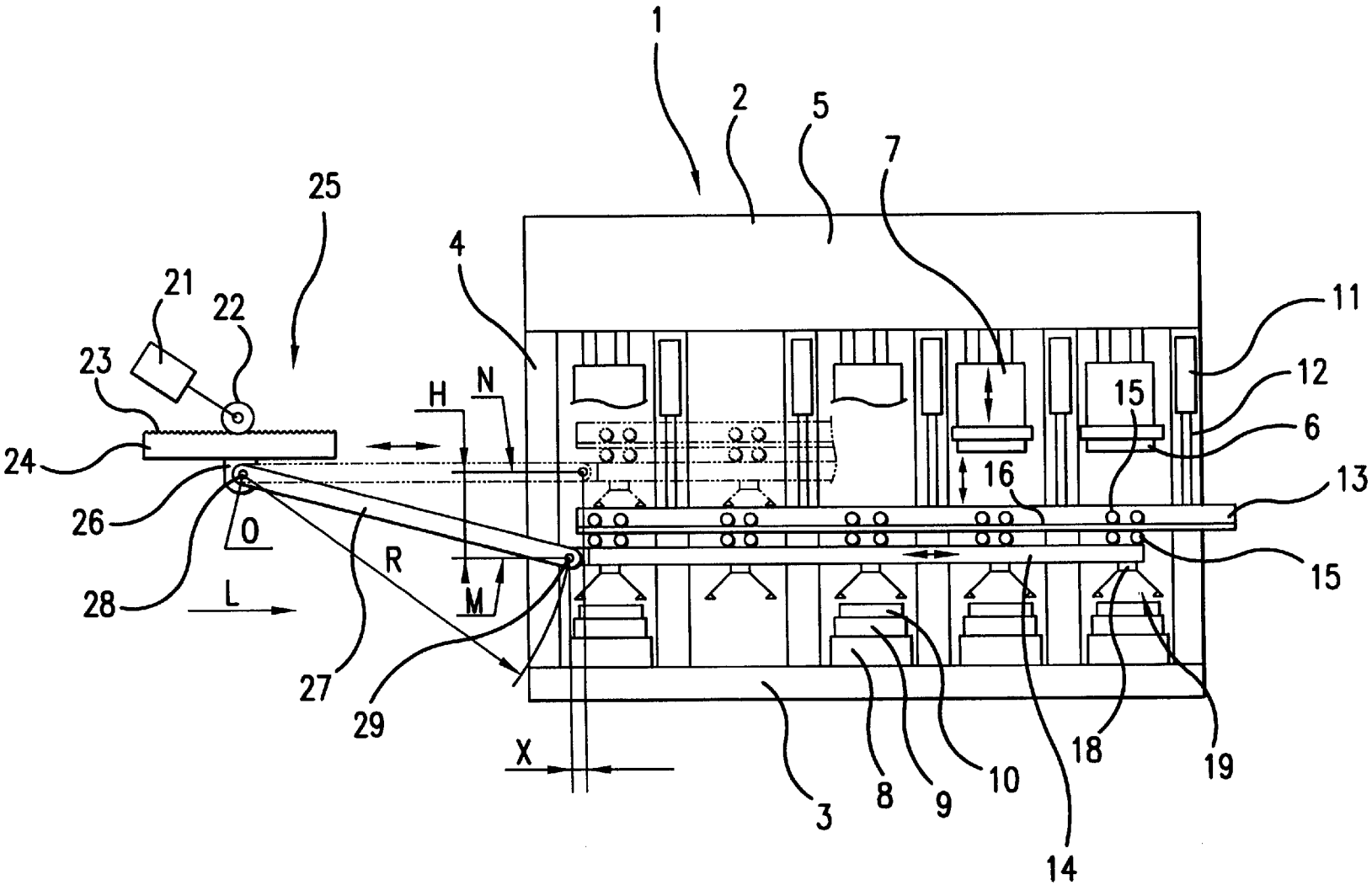
FIG. 1 is a schematic view showing a conventional apparatus for transferring and moving workpieces in a transfer press machine, known in the prior art.
Figure 2:
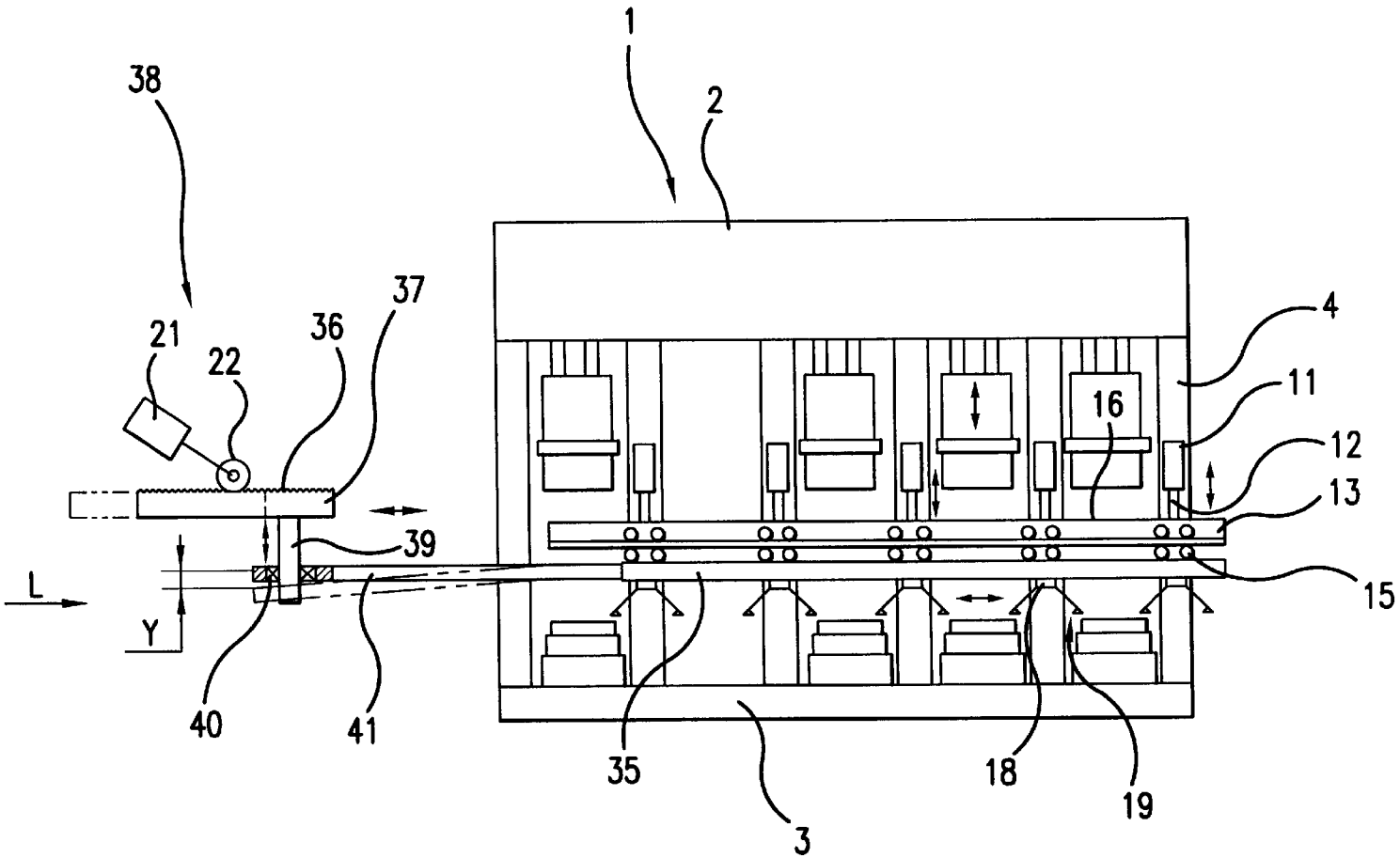
FIG. 2 schematically shows another device for transferring and moving workpieces in a transfer press machine, according to the prior art.

The preferred embodiments of the present invention are described as follows by referring to the drawings. The same item numbers are used in all the drawings to represent the same components, and no repeated descriptions are given.

Figure 3:
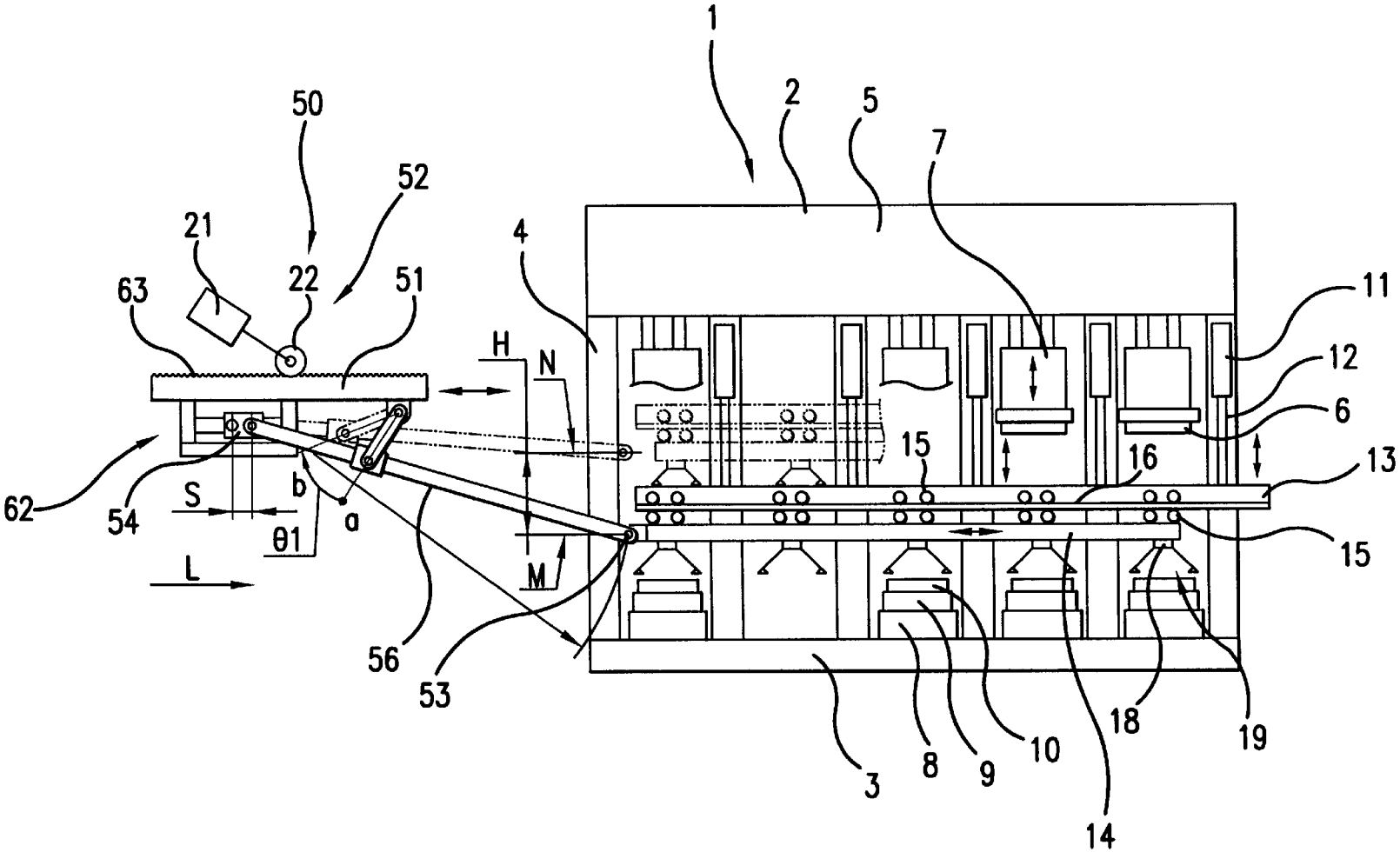
FIG. 3 is a view showing the general configuration of the first embodiment of an apparatus for transferring and moving workpieces in a transfer press machine, according to the present invention.
Figure 4:
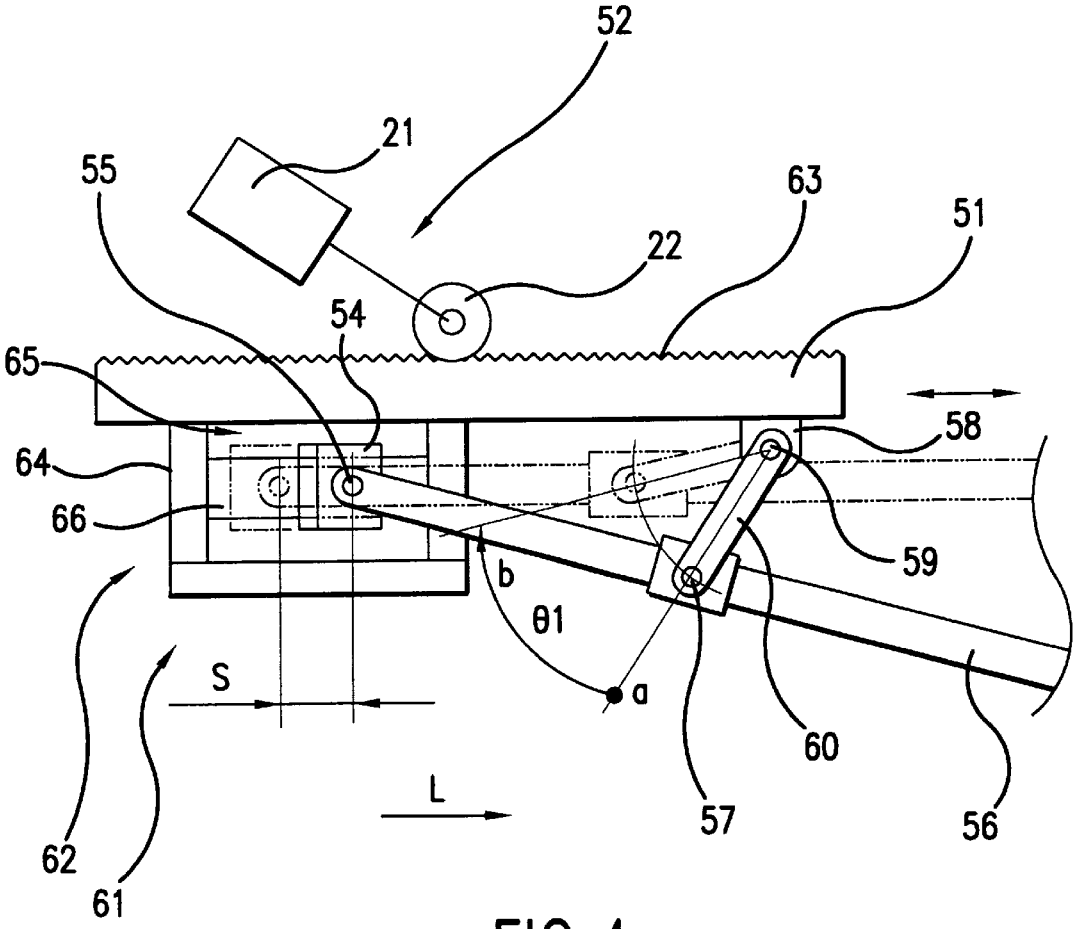
FIG. 4 is an enlarged view of part of FIG. 3 showing the operating direction changeover mechanism.

FIG. 3 is a view showing the general configuration of the first embodiment of an apparatus for transferring and moving workpieces in a transfer press machine, according to the present invention. FIG. 4 is an enlarged view showing the operating direction changeover mechanism of the present invention.

The apparatus shown in FIG. 3 is a transfer press machine of the servo motor driven type with the same configuration as that shown in FIG. 1. In FIG. 3, an apparatus for transferring and moving workpieces according to the present invention is composed of upper and lower dies 6, 10 in a main press unit 2, at predetermined intervals along a press line L for continuously pressing and processing workpiece, a pair of lift beams 13 arranged opposite each other and parallel to the press line L on both sides of the dies and capable of being freely raised and lowered, workpiece holders 19 from which the workpieces are hung and which deliver the workpieces to and remove them from the lower dies 10, cross bars 18 that hold the workpiece holders 19 and are arranged perpendicular to the press line L at predetermined intervals, and a pair of feed beams 14 on which the cross bars 18 are supported and which are suspended from the lift beams 13 and can move freely in the horizontal direction of the press line. The feed beams 14 can be moved in the direction of the press line L by a feed and transfer device 52 comprised of a servo motor 21, a pinion 22 and a rack beam 51. Therefore, using the aforementioned apparatus according to the present invention, the workpiece can be conveyed to the dies arranged in series at predetermined intervals, by the lift beams that can be moved up and down and by moving the feed beams, which are suspended from the lift beams and which carry the workpiece holders in the direction of the press line L by means of the feed and transfer device.

In addition, as shown in FIGS. 3 and 4, the apparatus 50 for transferring and moving the workpieces is also provided with a connecting rod 56, a connecting link 60, and an operating direction changeover mechanism 61; one end of the connecting rod is connected to the feed beams 14 through a connecting pin 53, and the other end thereof is connected through a connecting pin 55 to a slider 54, to be described in detail later, installed on the rack beam 51; the connecting link 60 is connected in a freely rotatable manner to an intermediate portion of the connecting rod 56 through the pin 57 and to the bracket 58 provided on the rack beam 51 through the pin 59; and the operating direction changeover mechanism 61 converts the unwanted differential movement caused by the curvature of the press transfer motion, produced in the feed beams 14 when the lift beams 13 are moved up or down, to a horizontal movement in the direction of the press line L in synchronism with the raising or lowering of the lift beams 13.

The operating direction changeover mechanism 61 is a horizontal guide device 62 attached to the feed and transfer device 52. The horizontal guide device 62 is configured with a horizontal guide unit 64 installed on the opposite side of the rack beam 51 to the rack 63 in the feed and transfer device 52, a horizontal rod 66 mounted in the aperture 65 of the horizontal guide unit 64 and extending in the direction of the press line L, and a slider 54 which can slide along the horizontal rod 66, and more freely in the direction of the press line L, and to which one end of the connecting rod 56 is attached by the connecting pin 55. In this configuration, the differential movement caused by the curvature of press transfer motion, produced in the feed beam as the lift beams are moved up or down, is converted to a horizontal operation in the direction of the press line L by the horizontal guide device, i.e. the operating direction changeover mechanism, installed in the feed and transfer device and operating in synchronism with the raising or lowering of the lift beam. Therefore, the unwanted movement caused by the curvature of the of a press transfer motion can quickly and easily be converted to a horizontal movement, so the unwanted movement caused by the curvature of the press transfer motion is canceled out.

Methods for transferring and moving workpieces in a transfer press machine according to the present invention will be described by referring to FIGS. 3 and 4. In these figures, the operating direction changeover mechanism 61 is shown which converts the unwanted differential movement caused by the curvature of the press transfer motion produced in the feed beams 14 when the lift beams 13 move up or down, to a movement in the direction of the press line L, and the rack beam 51 remains stationary at a predetermined location; (1) when the lift beam 13 begins to be raised from the position M to the position N which is at a predetermined height H above position M in order to transfer the workpiece to be pressed, (2) then the operating direction changeover mechanism 61 begins to operate in synchronism with the beginning of the upward movement of the lift beam 13, (3) first the connecting link 60 between the connecting rod 56 and the bracket 58 of the rack beam 51 rotates in the direction of the press line L from the position a through an angle θ1, corresponding to the aforementioned height of lift, to the position b, (4) next, as the connecting link 60 rotates, the slider 54 mounted on the tip of the connecting rod 56 slides along the horizontal rod 66 and moves horizontally in the direction of the press line L through a distance S, therefore the raising or lowering of the above-mentioned lift beam 13 can be easily converted to a horizontal movement of the slider 54 in synchronism with the raising or lowering operation. Consequently, when the lift beam moves up or down, the unwanted differential movement caused by the curvature of the press transfer motion, produced in the feed beam in association with the raising or lowering of the lift beam, can be converted to a horizontal movement in the direction of the press line using the simple operating direction changeover mechanism, in synchronism with the raising or lowering operation, so that the differential movement caused by the curvature of the press transfer motion can easily be eliminated. Furthermore, it is no longer necessary to operate the rack in a controlled manner to correct and eliminate the differential movement caused by the curvature of the press transfer motion during lifting.

Figure 5:
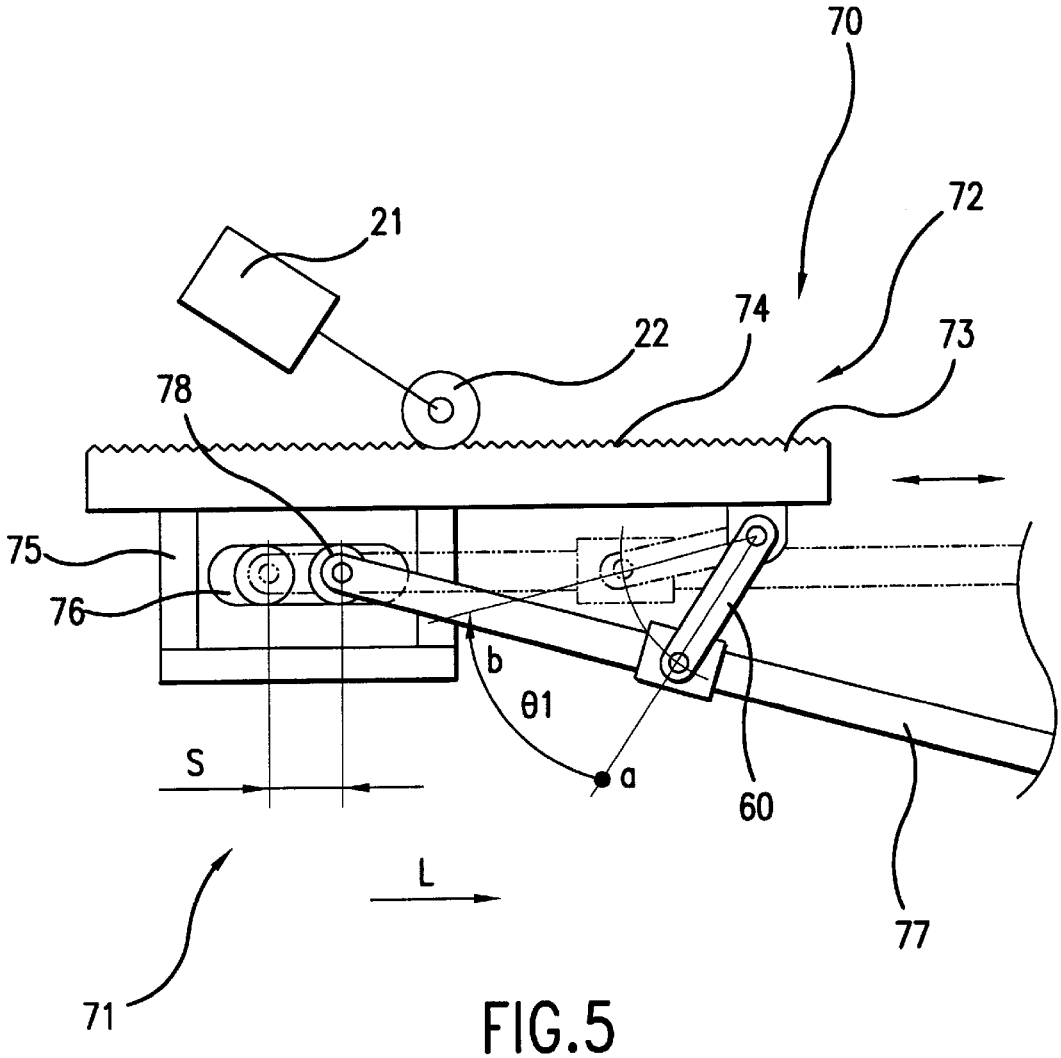
FIG. 5 is an enlarged view showing the operating direction changeover mechanism, of the second embodiment of the device for transferring and moving workpieces in a transfer press machine, according to the present invention.

FIG. 5 is an enlarged view showing the second embodiment of the operation direction changeover mechanism 70 of the apparatus for transferring and moving the workpiece in a transfer press machine according to the present invention.

The horizontal guide device 71 of the present invention is composed of a horizontal guide unit 75 mounted on the rack beam 73 on the opposite side to the rack 74 in the feed and transfer device 72, a long slot 76 provided in the horizontal guide unit 75 and extending in the direction of the press line L, and a roller-shaped rotating shaft unit 78 attached to the tip of the connecting rod 77 on the feed beam 14 side and provided with a built-in bearing, not illustrated and guided by the long slot 76 so that it can move freely in the direction of the press line L. Also using this system, unwanted differential movement caused by the curvature of the press transfer motion, produced in the feed beam 14 in synchronism with the raising and lowering of the lift beam 13, can be easily converted to a horizontal movement of the roller 78, and so eliminate the differential movement, because the connecting link 60 between the connecting rod 77 and the rack beam 73 is rotated from position a to position b through an angle θ1, thereby moving the rotating shaft unit 78 guided by the long slot 76 horizontally with a stroke s in the direction of the press line L.

Figure 6:
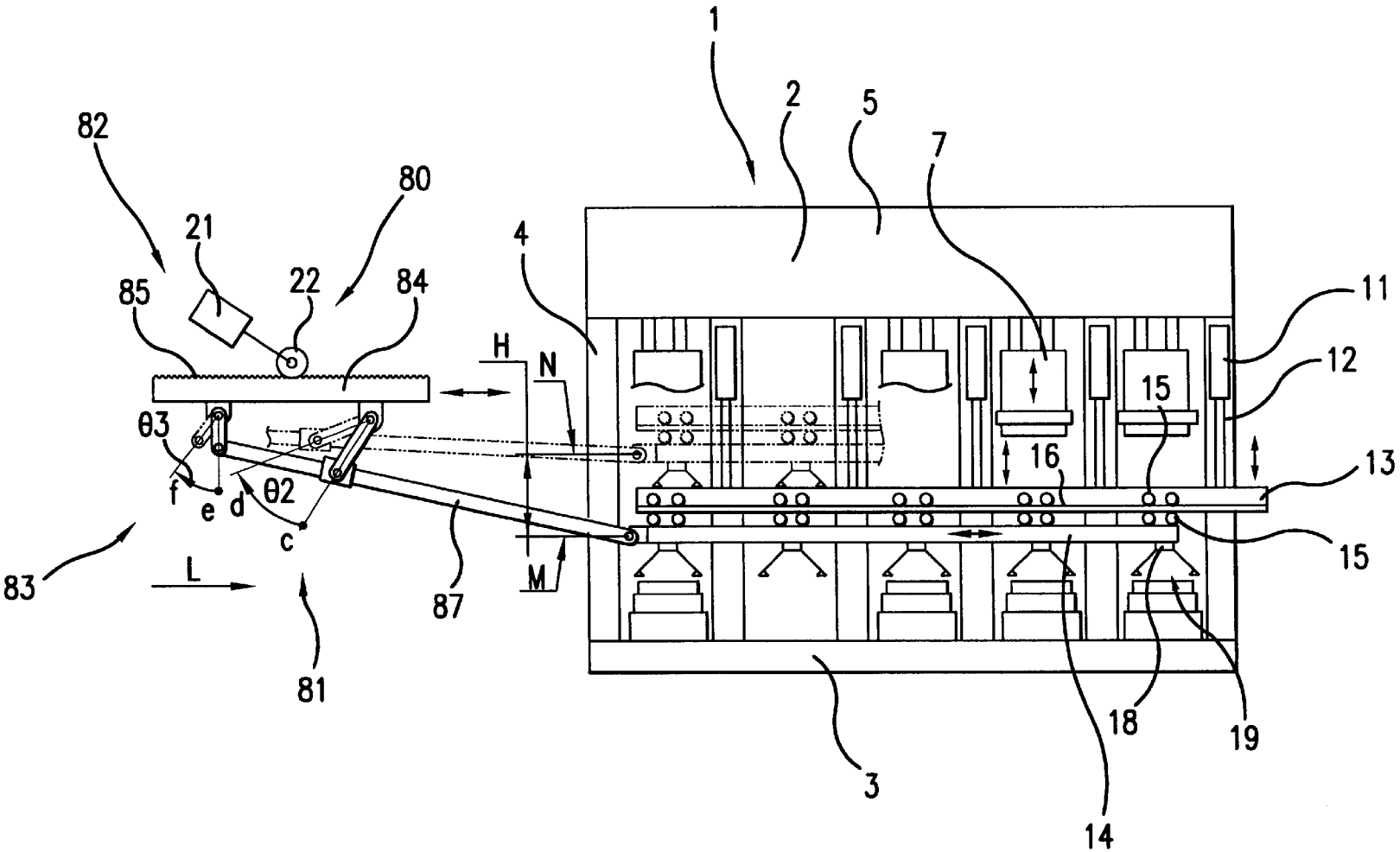
FIG. 6 is a schematic drawing showing the third embodiment of the apparatus for transferring and moving workpieces in a transfer press machine, according to the present invention.
Figure 7:
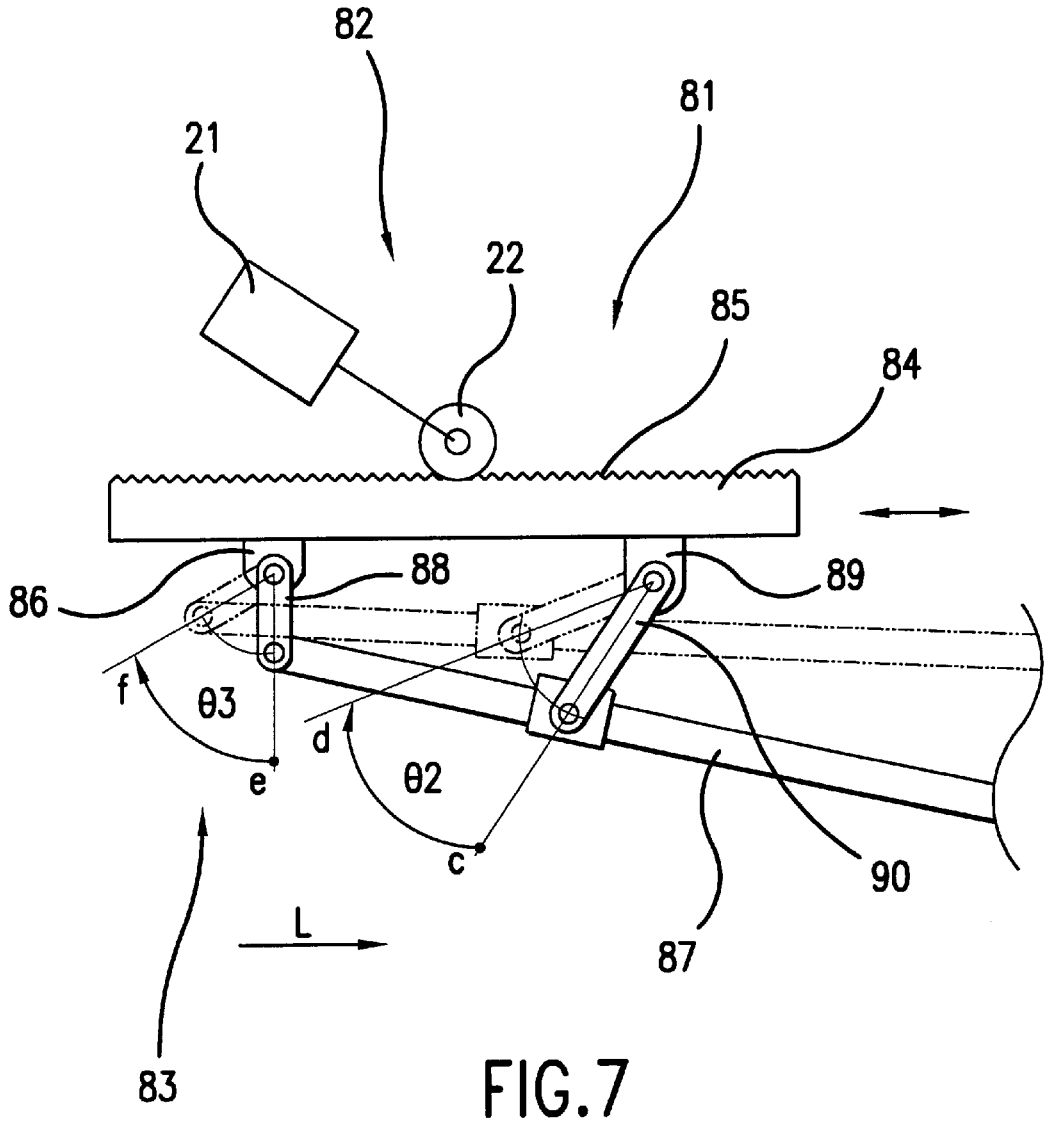
FIG. 7 is an enlarged view of part of FIG. 6 showing the operating direction changeover mechanism.

FIG. 6 shows a general configuration of the third embodiment of the apparatus for transferring and moving the workpiece in a transfer press machine according to the present invention. FIG. 7 is an enlarged view of the operating direction changeover mechanism of the present invention.

In FIGS. 6 and 7, the operating direction changeover mechanism 81 of the apparatus 80 for transferring and moving the workpiece according to the present invention is a link mechanism 83 provided in the feed and transfer device 82. The link mechanism 83 is provided with a bracket 86 mounted on the rack beam 84 on the opposite side to the rack 85 in the feed and transfer device 82, and a changeover link 88 connecting the bracket 86 to the tip of the connecting rod 87 on the opposite side to the feed beam 14 in such a manner that the changeover, link 88 can freely rotate in the direction of the press line L. In addition, a bracket 89 is installed on the rack beam 84 on the opposite side to the rack 85 to which a connecting link 90 is connected that can freely rotate relative to the connecting rod 87. In other words, the present link mechanism 83 is composed of a double link mechanism comprised of the changeover link 88 and the connecting link 90.

The methods of transferring and moving workpiece in a transfer press machine according to the present invention will be described by referring to FIGS. 6 and 7. In these figures, (1) when the lift beam 13 begins to be raised from position M to position N through a predetermined height H, (2) the operating direction changeover mechanism 81 begins to operate in synchronism with the upward movement of the lift beam 13, so (3) the connecting link 90 between the connecting rod 87 and the bracket 89 on the rack beam 84 rotates through an angle θ2 in the direction of the press line L from position c to position d, corresponding to the height H of the lift, (4) then the changeover link 88 connected to the tip of the connecting rod 87 rotates through an angle θ3 in the direction of the press line L from position e to position f, corresponding to the height H of the lift in synchronism with the rotation of the connecting link 90, thus the unwanted differential movement caused by the curvature of the press transfer motion, associated with the aforementioned raising of the lift beam 13 can easily be converted to a horizontal movement of the changeover link 88 in synchronism with the upward movement. Consequently, the same effects as those described for the other embodiments of the present invention can be achieved.

According to the apparatus and methods of transferring and moving workpiece in a transfer press machine, provided by the present invention, (1) the unwanted differential movement caused by the curvature of the press transfer motion, associated with a raising or lowering operation, can be converted to a movement in the direction of the press line, (2) the unwanted differential movement caused by the curvature of the press transfer motion can be eliminated, (3) the curvature of the press transfer motion due to lifting the rack need not be compensated for by a complicated control procedure, and (4) the workpiece can be transferred and moved by the simple mechanism, with excellent results in practice.

Although the present invention has been described referring to the several preferred embodiments, it can be easily understood that the scope of rights included in the present invention are not limited only to these embodiments. Conversely, the scope of the rights of the present invention include all modifications, corrections and the like covered by the scope of the attached claims.

What is claimed is:

1. An apparatus for transferring and moving a workpiece in a transfer press machine having a press line having dies and a transfer feed direction, comprising a pair of lift beams arranged opposite each other and parallel to the press line, so that they can be freely raised and lowered, cross bars that cross the press line and support workpiece holders on which the workpiece can be hung and which place the workpiece onto the dies of the tress line and remove the workpiece from the dies, a pair of feed beams to which the cross bars are attached, suspended from the lift beams and free to move horizontally in the transfer feed direction of the press line, a feed and transfer device, comprising a servo motor, a pinion and a rack beam having a rack, for moving the feed beams in the transfer feed direction of the press line, a connecting rod connecting the feed beams and the rack beam, which can rotate freely, a connecting link connecting a point in an intermediate portion of the connecting rod to a point on the rack beam, and an operating direction changeover mechanism that, when the lift beams are raised or lowered, allows the connecting link to be displaced, in synchronism with the raising or lowering of the lift beams, in the transfer feed direction of the press line.

2. The apparatus according to claim 1, in which said operating direction changeover mechanism comprises a horizontal guide device or a link device arranged on the feed and transfer device.

3. The apparatus according to claim 1, wherein the operating direction changeover mechanism comprises a horizontal guide device including a horizontal guide unit mounted on the rack beam of the feed and transfer device on a side opposite to the rack, a horizontal rod mounted in an aperture of the horizontal guide unit, and extending in the transfer feed direction of the press line, and a slider mounted on a tip of the connecting rod opposite the feed beams, that is guided by the horizontal rod and capable of moving in the transfer feed direction of the press line.

4. The apparatus according to claim 1, wherein the operating direction changeover mechanism comprises a horizontal guide device including a horizontal guide unit mounted on the rack beam of the feed and drive device on a side opposite to the rack, a long slot provided in the horizontal guide unit, extending in the transfer feed direction of the press line, and a rotating shaft unit mounted on a tip of the connecting rod on a side opposite to the feed beams, and guided by the long slot in a manner such that the rotating shaft unit is free to move in the transfer feed direction of the press line.

5. The apparatus according to claim 1, wherein the operating direction changeover mechanism comprises a link device including brackets mounted on the rack beam of the feed and transfer device on a side opposite to the rack and a changeover link that connects the bracket to a tip of the connecting rod on a side opposite to the feed beams, in such a manner that the changeover link can freely rotate in the transfer feed direction of the press line.

6. A method of transferring and moving a workpiece in a transfer press machine having dies arranged in the press machine at predetermined intervals along a feed transfer direction of the press machine for continuously pressing and processing the workpiece, comprising the steps of:

moving feed beams in the feed transfer direction of the press machine by means of a feed and transfer device comprising a servo motor, a pinion and a rack beam, raising and lowering lift beams from which the feed beams are hung, and displacing a connecting rod, connecting the feed beams and the rack beam, in the feed transfer direction with an operating direction changeover mechanism when the lift beams are raised and lowered.

* * * * *